US010150313B2

(12) United States Patent
Nakata

(10) Patent No.: US 10,150,313 B2
(45) Date of Patent: Dec. 11, 2018

(54) PRINTING APPARATUS

(71) Applicant: SEIKO EPSON CORPORATION, Tokyo (JP)

(72) Inventor: Toshio Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/612,374

(22) Filed: Jun. 2, 2017

(65) Prior Publication Data

US 2017/0348988 A1 Dec. 7, 2017

(30) Foreign Application Priority Data

Jun. 3, 2016 (JP) ..... 2016-111600

(51) Int. Cl.
*B41J 15/04* (2006.01)

(52) U.S. Cl.
CPC ..... *B41J 15/046* (2013.01)

(58) Field of Classification Search
CPC ..... B41J 15/046
See application file for complete search history.

(56) References Cited

U.S. PATENT DOCUMENTS

2004/0189783 A1* 9/2004 Mogi ..... B41J 2/32 347/218
2012/0050438 A1* 3/2012 Wada ..... B65H 23/1955 347/104

FOREIGN PATENT DOCUMENTS

JP 2012-046261 A 3/2012
JP 2014-069932 A 4/2014

* cited by examiner

*Primary Examiner* — Jason S Uhlenhake
(74) *Attorney, Agent, or Firm* — Workman Nydegger

(57) ABSTRACT

A printing apparatus is provided with: a recording head that performs printing on a medium fed out from a transport roller pair; a feeding unit that feeds the medium to the transport roller pair; and a winding unit that winds, into a roll shape, the medium subjected to the printing by the recording head. The winding unit winds the medium while adjusting a front tension acting on the medium between the transport roller pair and the winding unit, depending on a diameter of the medium wound into the roll shape. The feeding unit feeds the medium while adjusting a back tension acting on the medium between the transport roller pair and the feeding unit, depending on changes in the front tension.

4 Claims, 3 Drawing Sheets

PRINTING APPARATUS

BACKGROUND

1. Technical Field

The present invention relates to a printing apparatus.

2. Related Art

For example, a medium processing apparatus (a printing apparatus) is proposed that transports a medium using a roll-to-roll method and performs processing (printing) on the medium (JP-A-2014-69932, for example).

The printing apparatus disclosed in JP-A-2014-69932 includes: a medium feeding mechanism that feeds a medium wound into a roll shape; a main body unit that performs printing on the medium; a medium winding mechanism that winds, into a roll shape, the medium subjected to the printing; a second tension applying unit that applies a tension to the medium between the medium feeding mechanism and the main body portion; and a first tension applying unit that applies a tension to the medium between the medium winding mechanism and the main body portion. Further, the first tension applying unit and the second tension applying unit control the tension applied to the medium such that the tension applied to the medium is constant.

However, when the medium is wound with the constant tension simply applied to the medium, a problem arises in which a wound shape of the medium easily becomes irregular due to a meandering movement of the medium. For example, when the medium is wound with a smaller tension applied to the medium, the medium that has been wound ends up in a loosely wound state, and a winding position is easily displaced.

Further, another problem arises in which, when the medium is wound while the tension applied to the medium is changed in order to inhibit the irregularity of the wound shape of the medium, characters and/or graphics printed on the medium are easily distorted, thus making it difficult to perform high-precision printing.

SUMMARY

An advantage of some aspects of the invention is to solve at least some of the above-described problems, and the invention can be realized as the following embodiments or application examples.

APPLICATION EXAMPLE 1

A printing apparatus according to the present application example includes: a printing unit configured to perform printing on a medium fed out from a transport roller pair; a feeding unit configured to feed the medium to the transport roller pair; and a winding unit configured to wind, into a roll shape, the medium subjected to the printing by the printing unit. The winding unit winds the medium while adjusting a front tension acting on the medium between the transport roller pair and the winding unit, depending on a diameter of the medium wound into the roll shape. The feeding unit feeds the medium while adjusting a back tension acting on the medium between the transport roller pair and the feeding unit, depending on changes in the front tension.

With the medium wound into the roll shape by the winding unit (hereinafter referred to as a roll body) in which a portion on a side closer to the center of the roll body has been loosely wound and a portion on a side further away from the center of the roll body has been tightly wound, when a new medium is wound around the outer peripheral surface of the already loosely wound roll body, the outer peripheral surface of the already loosely wound roll body is prone to deform as a result of yielding to a force applied by the new medium wound around the outer peripheral surface, which results in a defect such as wrinkling.

On the other hand, with the medium tightly wound on the side closer to the center of the roll body and loosely wound on the side further away from the center of the roll body, when a new medium is wound around the outer peripheral surface of the already tightly wound roll body, the outer peripheral surface of the already tightly wound roll body is less prone to deform as a result of yielding to the force applied by the new medium wound around the outer peripheral surface, which suppresses the occurrence of the defect such as the wrinkling.

Therefore, it is preferable that the winding unit tightly wind the medium on the side closer to the center of the roll body and loosely wind the medium on the side further away from the center of the roll body. Specifically, it is preferable that the winding unit wind the medium while adjusting the front tension depending on the diameter of the medium wound into the roll shape.

In the printing unit, printing is performed on the medium fed out from the transport roller pair. When a movement amount (a movement speed) of the medium fed out from the transport roller pair changes, a length of a printed object changes. Thus, it is necessary to keep constant the movement amount of the medium fed out from the transport roller pair. However, the movement amount of the medium fed out from the transport roller pair is influenced by the front tension and the back tension. Thus, when the front tension is adjusted (changed) so as to suppress the defect such as the wrinkling, the movement amount of the medium fed out from the transport roller pair changes.

Thus, when the front tension is adjusted (changed) by the winding unit, adjusting (changing) the back tension so as to offset the influence of the changes in the front tension allows the movement amount of the medium fed out from the transport roller pair to be kept constant. Further, when the movement amount of the medium fed out from the transport roller pair is kept constant, distortion of characters and/or graphics printed on the medium, and the like are suppressed, which allows high-quality, high-precision printing to be performed. Therefore, in order for the winding unit to adjust (change) the front tension, it is preferable that the feeding unit adjust (change) the back tension depending on the changes in the front tension.

APPLICATION EXAMPLE 2

In the printing apparatus according to the above-described application example, it is preferable that a difference between the front tension and the back tension be substantially constant.

The front tension is a force (a tension) acting on the medium between the transport roller pair and the winding unit. Thus, the front tension causes a force directed from the transport roller pair toward the winding unit to act on the medium. The back tension is a force (a tension) acting on the medium between the transport roller pair and the feeding unit. Thus, the back tension causes a force directed from the transport roller pair toward the feeding unit, that is, a force directed in the opposite direction to the direction from the transport roller pair toward the winding unit, to act on the medium.

The front tension and the back tension cause the forces, which are directed in the opposite direction to each other, to act on the medium. Thus, when the front tension and the back tension are made greater at the same time, the influence of the changes in the front tension on the medium can be offset. In a similar manner, when the front tension and the back tension are made smaller at the same time, the influence of the changes in the front tension on the medium can be offset.

Therefore, when the front tension is adjusted (changed) by the winding unit, adjusting (changing) the back tension so as to offset the influence of the changes in the front tension allows the movement amount of the medium fed out from the transport roller pair to be kept constant. Specifically, when the front tension is adjusted (changed) by the winding unit, adjusting (changing) the back tension so as to keep constant the difference between the front tension and the back tension allows the influence of the changes in the front tension to be offset and the movement amount of the medium fed out from the transport roller pair to be kept constant.

Further, when the movement amount of the medium fed out from the transport roller pair is kept constant, the distortion of the characters and/or graphics printed on the medium and the like are suppressed, which allows the high-quality, high-precision printing to be performed.

APPLICATION EXAMPLE 3

In the printing apparatus according to the above-described application examples, it is preferable that the winding unit adjust the front tension to make the front tension smaller as a diameter of the medium wound into the roll shape becomes greater.

As described above, in order to suppress the occurrence of the defect such as the wrinkling, it is preferable that the winding unit tightly wind the medium on the side closer to the center of the roll body and loosely wind the medium on the side further away from the center of the roll body. Specifically, it is preferable that the winding unit adjust the front tension to make the front tension weaker as the diameter of the medium wound into the roll shape becomes greater, that is, as the medium moves further away from the center of the roll body.

APPLICATION EXAMPLE 4

In the printing apparatus according to the above-described application examples, it is preferable that the winding unit adjust the front tension to make the front tension stronger as winding of the medium ends.

When a smaller front tension is maintained until the end of the winding of the medium, a portion near the outer peripheral surface of the roll body is loosely wound, causing winding displacement to be prone to occur near the outer peripheral surface of the roll body. Thus, when the front tension is made greater as the winding of the medium ends, the loosely wound state near the outer peripheral surface of the roll body is avoided, causing the winding displacement to be less likely to occur near the outer peripheral surface of the roll body.

BRIEF DESCRIPTION OF THE DRAWINGS

The invention will be described with reference to the accompanying drawings, wherein like numbers reference like elements.

DESCRIPTION OF EMBODIMENTS

An exemplary embodiment of the invention is described below with reference to the accompanying drawings. The exemplary embodiment illustrates one aspect of the invention, and does not limit the invention in any way. The exemplary embodiment can be modified as desired without departing from the scope of the technical concept of the invention. Further, in each of the drawings below, in order to make each of the layers, members, and the like recognizable in terms of size, each of the layers, members, and the like are illustrated to be different to an actual scale.

Exemplary Embodiment

Overview of Printing Apparatus

Figure 1:
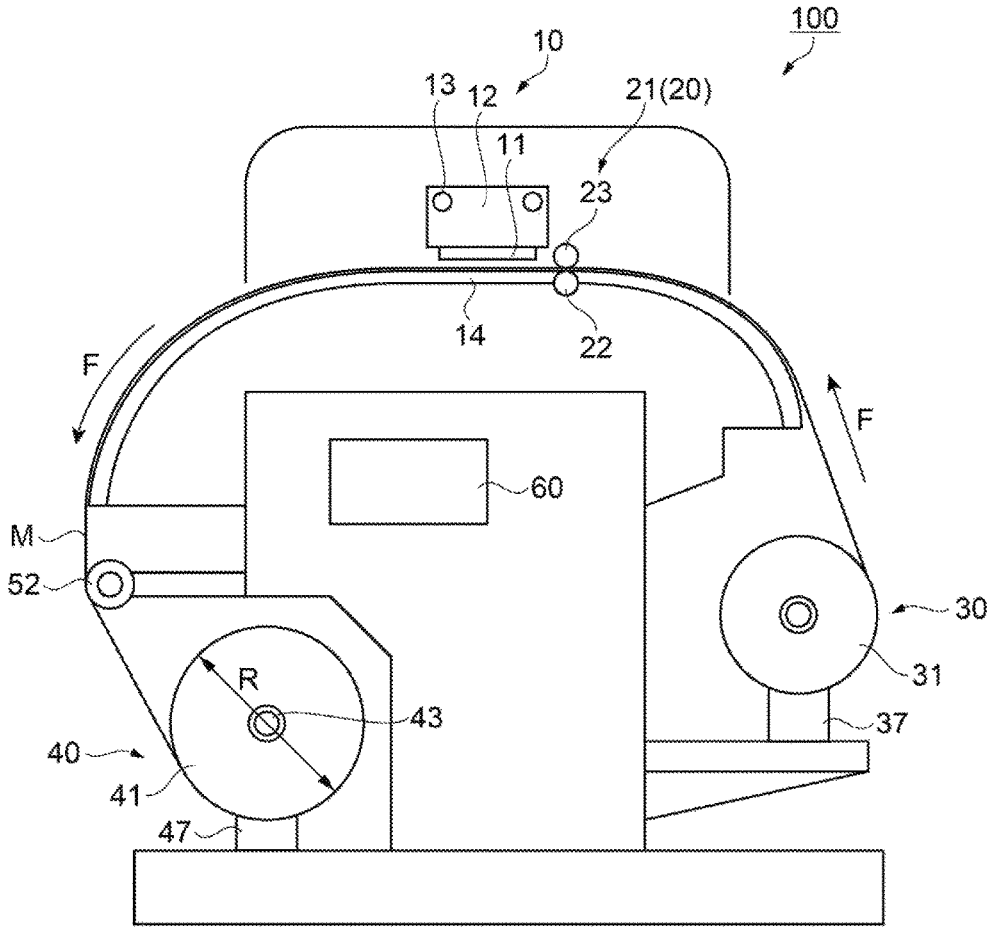
FIG. 1 is a schematic side view of a printing apparatus according to an exemplary embodiment.
Figure 2:
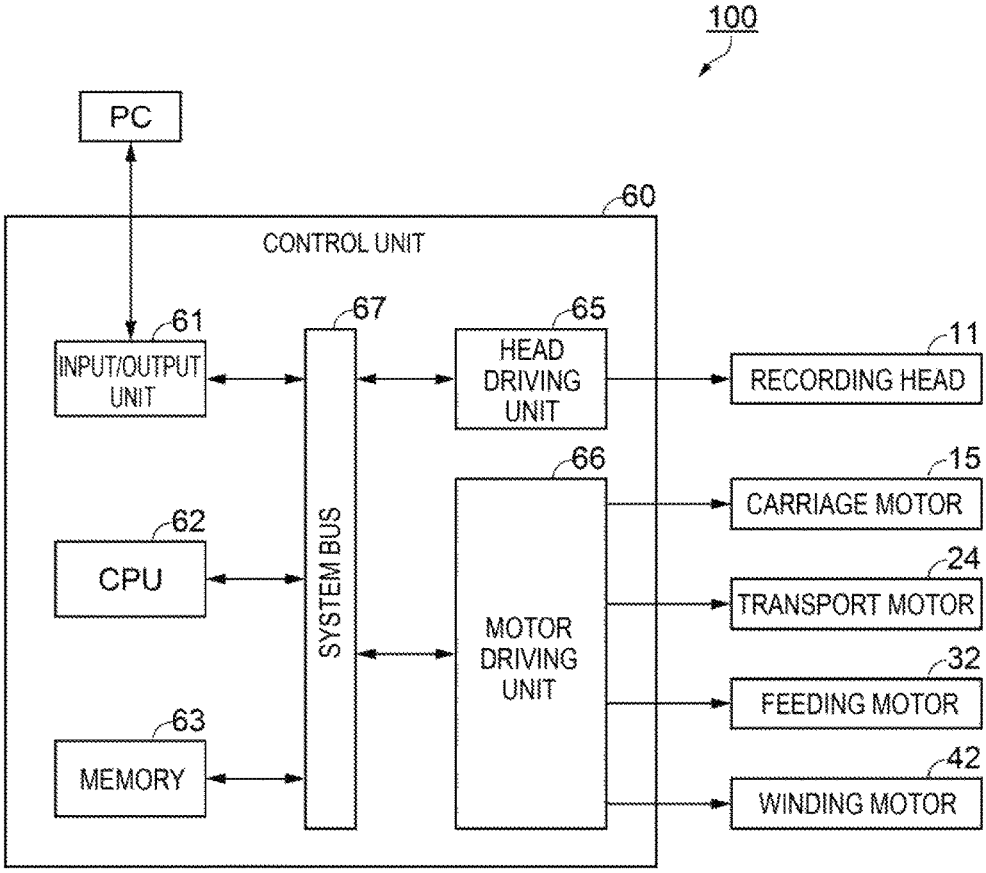
FIG. 2 is a control block diagram of the printing apparatus according to the exemplary embodiment.

FIG. 1 is a schematic side view of a printing apparatus according to an exemplary embodiment. FIG. 2 is a control block diagram of the printing apparatus according to the present exemplary embodiment.

First, with reference to FIG. 1 and FIG. 2, an overview of a printing apparatus 100 according to the exemplary embodiment is described.

As illustrated in FIG. 1, the printing apparatus 100 according to the exemplary embodiment is a large format printer (LFP) that handles a long medium (sheet) M. The printing apparatus 100 is provided with a feeding unit 30, a transport unit 20, a recording unit 10, and a winding unit 40, which are disposed in this order along a transport direction F of the medium M. Further, the printing apparatus 100 is provided with a control unit 60 that controls each of units and portions of the printing apparatus 100.

The medium M is fed out from the feeding unit 30 and passes through a transport roller pair 21. After printing (recording) is performed by the recording unit 10, the medium M is wound by the winding unit 40. Woodfree paper, cast coated paper, art paper, coat paper, synthetic paper, or a film formed of polyethylene terephthalate (PET), polypropylene (PP) or the like can be used as the medium M, for example.

A feeding-side roll body 31 formed of the medium M wound into a roll shape, is set in the feeding unit 30. The feeding unit 30 is provided with a feeding-side support portion 37 and a feeding motor 32 (see FIG. 2). The feeding-side support portion 37 rotatably supports the feeding-side roll body 31. The feeding motor 32 is a driving source that rotates the feeding-side roll body 31. When the feeding motor 32 operates, the feeding-side roll body 31 rotates in a feeding direction, which causes the medium M to be fed out from the feeding-side roll body 31 in the transport direction F. Then, the feeding unit 30 feeds the medium M to the transport roller pair 21.

The transport unit 20 is provided with the transport roller pair 21 and a transport motor 24 (see FIG. 2). The transport roller pair 21 transports the medium M fed out from the feeding-side roll body 31 toward the recording unit 10 and the winding unit 40. The transport roller pair 21 is provided with a driving roller 22 and a driven roller 23. The driven roller 23 is disposed so as to bring the medium M into pressure contact between the driving roller 22 and the driven roller 23, and is caused to rotate by the rotation of the driving roller 22. The transport motor 24 is a driving source that rotates the driving roller 22. When the transport motor 24 operates, the driving roller 22 rotates, which causes the medium M interposed between the driving roller 22 and the driven roller 23 to be fed out in the transport direction F.

The recording unit 10 is provided with a recording head 11, which is an example of a "printing portion," a carriage 12, a guide shaft 13, a medium support portion 14, and a carriage motor 15 (see FIG. 2). The recording head 11 is an ink jet head provided with a plurality of nozzles that discharge ink. The recording head 11 discharges the ink onto the medium M transported from the transport roller pair 21, and prints an image on the medium M. Specifically, the recording head 11 functions as a printing portion that performs printing on the medium M transported from the transport roller pair 21. The guide shaft 13 extends in a direction (a scanning direction) intersecting with the transport direction F in which the medium M moves, and supports the carriage 12. The carriage 12 has the recording head 11 mounted thereon, and is caused to reciprocate along the guide shaft 13 (the scanning direction) by the carriage motor 15 driven and controlled by the control unit 60. The medium support portion 14 is provided with a substantially rectangular upper surface facing the recording head 11. The longitudinal direction of the rectangular upper surface is a width direction of the medium M. The medium M is suctioned and supported on the upper surface of the medium support portion 14 by a negative pressure applied by the medium support portion 14. This configuration suppresses a deterioration in the printing quality due to lifting of the medium M.

Then, the printing apparatus 100 alternately repeats a droplet discharge operation, in which the recording unit 10 discharges the ink as ink droplets from the recording head 11 while moving the recording head 11 in the scanning direction, and a transport operation, in which the transport roller pair 21 moves the medium M in the transport direction F, to form dots on the medium M, thereby printing a specific image on the medium M. Specifically, a line (raster line) of dots is formed in the scanning direction by the droplet discharge operation, and the line (raster line) of dots is arranged side by side in the transport direction F at equal intervals by the transport operation, thereby printing the specific image.

Note that, in the exemplary embodiment, although a serial head-type recording head, which is mounted on the reciprocating carriage 12 and discharges the ink while moving in the width direction (the scanning direction) of the medium M, has been illustrated as an example of the recording head 11, a line head-type recording head, which extends in the width direction (the scanning direction) of the medium M and is arranged in a fixed manner, may be used as the recording head 11.

The winding unit 40 is provided with a winding-side support portion 47 and a winding motor 42 (see FIG. 2), and causes the medium M fed out from the recording unit 10 (from the transport roller pair 21) to be wound into the roll shape. The winding-side support portion 47 rotatably supports a paper tube for winding (a winding core) 43. A tip portion of the medium M is attached to the paper tube 43. The paper tube 43 is rotated by the power transmitted from the winding motor 42. Specifically, the winding motor 42 is a driving source that rotates the paper tube 43. When the winding motor 42 rotates in one direction, the paper tube 43 rotates in a winding direction, which causes the medium M to be wound around the paper tube 43. Note that a roll body 41 formed of the medium M wound around the paper tube 43 is hereinafter referred to as a winding-side roll body 41.

Further, when the winding motor 42 rotates in the other direction, the paper tube 43 rotates in the opposite direction to the winding direction, which causes the medium M wound around the paper tube 43 to be unwound.

The cross section of the winding-side roll body 41 has a circular shape, and the outer diameter (the diameter) of the winding-side roll body 41 is denoted as R. As the paper tube 43 rotates in the winding direction to wind the medium M therearound, the outer diameter R of the winding-side roll body 41 gradually becomes greater. As the paper tube 43 rotates in the opposite direction to the winding direction to unwind the medium M therefrom, the outer diameter R of the winding-side roll body 41 gradually becomes smaller.

Note that the outer diameter R of the winding-side roll body 41 is an example of the "diameter of the medium wound into the roll shape."

A rotary bar member 52, which comes into contact with the medium M, is provided on a transport path between the recording unit 10 and the winding unit 40. The rotary bar member 52 extends over the width direction of the medium M, and a rotating shaft of the rotary bar member 52 is fixedly supported on a main body of the printing apparatus 100. The rotary bar member 52 rotates along with the movement of the medium M with which the rotary bar member 52 is in contact, and supports the movement of the medium M.

As illustrated in FIG. 2, the control unit 60 is provided with an input/output unit 61, a CPU 62, a memory 63, a head driving unit 65, a motor driving unit 66, and a system bus 67, and controls each of the units and portions of the printing apparatus 100.

The input/output unit 61 causes data to be transmitted and received between an external device (a personal computer (PC), for example) and the printing apparatus 100.

The CPU 62 is an arithmetic processing unit for controlling each of the units and portions of the printing apparatus 100, and is connected to the input/output unit 61, the memory 63, the head driving unit 65, and the motor driving unit 66 via the system bus 67. The CPU 62 controls the head drive unit 65 and the motor driving unit 66 in accordance with recording jobs (print instructions) received from the external device or a program stored in the memory 63.

The memory 63 is constituted of a storage device such as a RAM, a ROM, or a flash memory. The memory 63 stores the program run by the CPU 62, and saves necessary information such as computation results of the CPU 62. Further, the memory 63 stores a tension function used for optimizing the tension acting on the medium M.

The control unit 60 can recognize a movement amount of the medium M fed out from the transport roller pair 21, a feeding speed of the medium M at the feeding unit 30, a winding speed of the medium M at the winding unit 40, and the like, on the basis of values read from rotary encoders provided individually in the transport unit 20, the feeding unit 30, and the winding unit 40. Note that a configuration may be adopted in which the movement amount, the speeds, and the like are measured by, for example, laser Doppler velocimeters, each provided in the transport unit 20, the feeding unit 30, and the winding unit 40.

The motor driving unit 66 controls a rotation speed of the winding motor 42 on the basis of a computation result obtained using the tension function to adjust a tension 45 acting on the medium M between the transport roller pair 21 and the winding unit 40. Note that the tension 45 is an example of a "front tension acting on the medium M between the transport roller pair 21 and the winding unit 40," and is hereinafter referred to as a front tension 45 (see FIG. 3).

The motor driving unit 66 controls a rotation speed of the feeding motor 32 on the basis of a computation result obtained using the tension function to adjust a tension 35 acting on the medium M between the transport roller pair 21 and the feeding unit 30.

Note that the tension 35 is an example of a "back tension acting on the medium M between the transport roller pair 21 and the feeding unit 30," and is hereinafter referred to as a back tension 35 (see FIG. 3).

Characteristic Points

Figure 3:
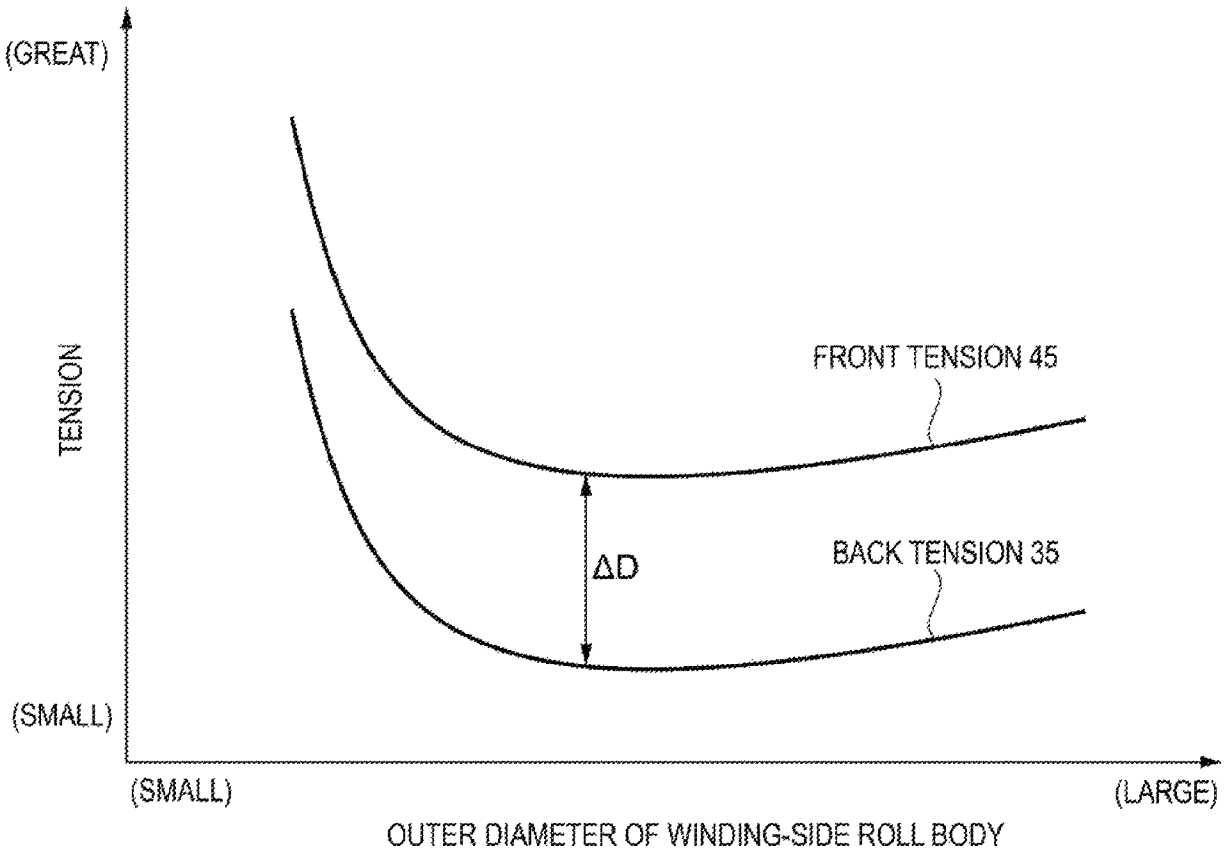
FIG. 3 is a graph showing relationships between the outer diameter of a winding-side roll body, a back tension, and a front tension.

FIG. 3 is a graph showing relationships between the outer diameter of the winding-side roll body 41, the back tension 35, and the front tension 45.

Next, with reference to FIG. 1 to FIG. 3, problems of the printing apparatus 100 and characteristic points of the exemplary embodiment for solving the problems are described.

With the winding-side roll body 41 loosely wound on a side closer to the paper tube 43 (on the inner side of the winding-side roll body 41) and tightly wound on a side further away from the paper tube 43 (on the outer peripheral surface side of the winding-side roll body 41), when a new medium M is wound around the outer peripheral surface of the already loosely wound roll body, the outer peripheral surface of the already loosely wound roll body is prone to deform as a result of yielding to a force applied by the new medium M wound around the outer peripheral surface, which results in a defect such as wrinkling (a star defect).

On the other hand, with the winding-side roll body 41 tightly wound on the side closer to the paper tube 43 (on the inner side of the winding-side roll body 41) and loosely wound on the side further away from the paper tube 43 (on the outer peripheral surface side of the winding-side roll body 41), when a new medium M is wound around the outer peripheral surface of the already tightly wound roll body, the outer peripheral surface of the already tightly wound roll body is less likely to deform as a result of yielding to the force applied by the new medium M, which suppresses the occurrence of the defect such as the wrinkling (the star defect).

Therefore, when the medium M is wound under conditions in which the front tension 45 is set to be smaller on the inner side of the winding-side roll body 41 and to be greater on the outer peripheral side surface side of the winding-side roll body 41, the defect such as the wrinkling is prone to occur on the winding-side roll body 41. Hereinafter, such a phenomenon in which the defect such as the wrinkling occurs is referred to as tight winding.

As described above, when the front tension 45 is smaller at the beginning of winding and the winding-side roll body 41 is loosely wound on the side closer to the paper tube 43 (on the inner side of the winding-side roll body 41), tight winding is prone to occur. When the front tension 45 is greater at the beginning of winding and the winding-side roll body 41 is tightly wound on the side closer to the paper tube 43 (on the inner side of the winding-side roll body 41), tight winding is less likely to occur.

Further, when all of the medium M is loosely wound or when some of the medium M is loosely wound, displacement is prone to occur during the winding, which likely causes an irregularity (shape collapse) of a wound shape of the winding-side roll body 41. Specifically, when the front tension 45 is generally smaller or when the front tension 45 becomes smaller during the winding, the displacement is prone to occur during the winding, which likely causes the irregularity (the shape collapse) of the wound shape of the winding-side roll body 41.

Hereinafter, such a phenomenon in which the warping (the shape collapse) of the wound shape of the winding-side roll body 41 occurs is referred to as winding displacement.

In the exemplary embodiment, when the medium M is wound by the winding unit 40 in synchronization with the transport operation of the transport roller pair 21 (the transport unit 20), a torque (the front tension 45) of the winding-side roll body 41 is optimized on the basis of a transport speed of the medium M and inertia (an inertia moment) of the winding unit 40, thereby suppressing the occurrence of the tight winding and the winding displacement.

As illustrated in FIG. 3, the winding unit 40 winds the medium M while adjusting the front tension 45 depending on the outer diameter R of the winding-side roll body 41 formed of the medium M wound into the roll shape.

In more detail, the winding unit 40 adjusts the front tension 45 to make the front tension 45 greatest when the outer diameter R of the winding-side roll body 41 is smallest, that is, when the winding unit 40 starts winding the medium M around the paper tube 43. Next, the winding unit 40 adjusts the front tension 45 to make the front tension 45 gradually smaller as the outer diameter R of the winding-side roll body 41 becomes greater. Then, after maintaining a state in which the front tension 45 is small, the winding unit 40 adjusts the front tension 45 to make the front tension 45 gradually greater and ends the winding of the medium M.

As described above, the winding unit 40 adjusts the front tension 45 to make the front tension 45 smaller as the outer diameter R of the winding-side roll body 41 becomes greater. Further, the winding unit 40 adjusts the front tension 45 to make the front tension 45 greater as the winding of the medium M ends.

When the front tension 45 is made greater at the beginning of the winding and made smaller as the winding progresses, the inner side of the winding-side roll body 41 is wound tightly, and the outer peripheral side surface side of the winding-side roll body 41 is wound loosely. Thus, when a new medium M is wound around the outer peripheral surface of the already tightly wound winding-side roll body 41, the outer peripheral surface of the already tightly wound winding-side roll body 41 is less likely to deform as a result of yielding to the force applied by the new medium M wound around the outer peripheral surface, which can suppress the tight winding. Therefore, adjusting the front tension 45 to make the front tension 45 smaller as the outer diameter R of the winding-side roll body 41 becomes greater can suppress tight winding.

Further, when a smaller front tension 45 is maintained until the end of the winding of the medium M, the winding-side roll body 41 is loosely wound on the outer peripheral surface side, causing the winding displacement to be prone to occur near the outer peripheral surface of the winding-side roll body 41. Thus, when the winding unit 40 adjusts the front tension 45 to make the front tension 45 greater as the winding of the medium M ends, the loosely-wound state on the outer peripheral surface side of the winding-side roll body 41 is eliminated, and the occurrence of the winding displacement near the outer peripheral surface of the winding-side roll body 41 can be suppressed.

For example, in order to make (produce) a printed object such as an extremely large poster using the printing apparatus 100, a plurality of separate printed objects are produced and then joined together to form the extremely large poster. When the quality (the length, color, and the like of the printed object) of printed object is different between the plurality of separate printed objects, problems arise in which the joints connecting the plurality of separate printed objects stand out, or the colors are different between the plurality of separate printed object. Thus, the quality of the printed object (the length, the colors and the like of the printed object) is required to be similar in each of the plurality of sections of the divided printed object.

As described above, in the printing apparatus 100, a line of dots are formed in the scanning direction by the droplet discharge operation, and the line of dots is arranged side by side in the transport direction F at equal intervals by the transport operation. As a result, the specific image is printed.

If the movement amount (the movement speed) of the medium M fed out from the transport roller pair 21 in the transport direction F fluctuates, the length of the printed object (the length in the transport direction F) fluctuates. Further, the interval between the lines of dots arranged side by side in the transport direction F fluctuates, and the density of the dots formed on the medium M fluctuates, making the colors of the printed object uneven. Therefore, when the movement amount of the medium M fed out from the transport roller pair 21 in the transport direction F fluctuates, the quality of the printed object (the length, the colors, and the like of the printed object) differs in each of the plurality of sections of the divided printed object.

Thus, in order to obtain a plurality of separate printed objects of the same quality, it is important to keep constant the movement amount of the medium M fed out from the transport roller pair 21 in the transport direction F.

The front tension 45 is the force (tension) acting on the medium M between the transport roller pair 21 and the winding unit 40. Thus, the front tension 45 causes a force directed from the transport roller pair 21 toward the winding unit 40, that is, a force directed in the transport direction F, to act on the medium M. The back tension 35 is the force (tension) acting on the medium M between the transport roller pair 21 and the feeding unit 30. Thus, the back tension 35 causes a force directed from the transport roller pair 21 toward the feeding unit 30, that is, a force directed in the opposite direction to the transport direction F, to act on the medium M.

Therefore, the movement amount (the movement speed) of the medium M fed out from the transport roller pair 21 in the transport direction F is influenced by the front tension 45 and the back tension 35.

For example, when the front tension 45 becomes greater than the back tension 35, the force directed in the transport direction F becomes greater, causing the movement amount of the medium M fed out from the transport roller pair 21 in the transport direction F to be greater. In contrast, when the back tension 35 becomes greater than the front tension 45, the force directed in the opposite direction to the transport direction F becomes greater, causing the movement amount of the medium M fed out from the transport roller pair 21 in the transport direction F to be smaller.

For example, when both the front tension 45 and the back tension 35 become greater, changes in the forces acting on the medium M offset each other, allowing the movement amount of the medium M fed out from the transport roller pair 21 in the transport direction F to be kept constant. In a similar manner, when both the front tension 45 and the back tension 35 become smaller, changes in the forces acting on the medium M offset each other, allowing the movement amount of the medium M fed out from the transport roller pair 21 in the transport direction F to be kept constant.

Therefore, when the winding unit 40 adjusts the front tension 45, it is preferable that the feeding unit 30 adjust the back tension 35 depending on the changes in the front tension 45 in order to keep constant the movement amount of the medium M fed out from the transport roller pair 21 in the transport direction F. Specifically, when the winding unit 40 adjusts the front tension 45 to make the front tension 45 greater, it is preferable that the feeding unit 30 adjust the back tension 35 to make the back tension 35 greater. When the winding unit 40 adjusts the front tension 45 to make the front tension 45 smaller, it is preferable that the feeding unit 30 adjust the back tension 35 to make back tension 35 smaller.

Therefore, as illustrated in FIG. 3, when the winding unit 40 changes (adjusts) the front tension 45, it is preferable that the feeding unit 30 adjust the back tension 35 depending on the changes in the front tension 45, such that a difference ΔD between the front tension 45 and the back tension 35 is constant. According to this configuration, the influence of the changes in the front tension 45 is offset by the changes in the back tension 35, and the movement amount of the medium M fed out from the transport roller pair 21 in the transport direction F can be kept constant.

Further, when the movement amount of the medium M fed out from the transport roller pair 21 in the transport direction F is kept constant, distortions of the characters and/or graphics printed on the medium M, fluctuations (unevenness) in the colors, and the like are suppressed, which allows high-quality, high-precision printing to be performed.

Note that, in the present application, the difference ΔD between the front tension 45 and the back tension 35 being constant corresponds to a state in which fluctuations of the difference ΔD between the front tension 45 and the back tension 35 are controlled to be within ±15% and to a state in which the difference ΔD between the front tension 45 and the back tension 35 is controlled to be in a range from 0.85 ΔD to 1.15 ΔD.

Note that, even when the difference ΔD between the front tension 45 and the back tension 35 deviates from the range from 0.85 ΔD to 1.15 ΔD, as long as the back tension 35 changes in a similar manner to the front tension 45, this is still within the technical scope of the application.

Specifically, if the back tension 35 changes in a similar manner to the front tension 45, the influence of the changes in the front tension 45 becomes small, which allows changes in the movement amount of the medium M fed out from the transport roller pair 21 to be small.

Further, even when the back tension 35 includes a portion that changes differently from the changes in the front tension 45, as long as it is considered that the back tension 35 changes in a substantially similar manner to the front tension 45, this is still within the technical scope of the application.

Specifically, if the back tension 35 changes in a substantially similar manner to the front tension 45, the influence of the changes in the front tension 45 becomes small, which allows the changes in the movement amount of the medium M fed out from the transport roller pair 21 to be small.

Note that a preferable magnitude correlation between the front tension 45 and the back tension 35 changes depending on a type of the medium M, a type of the ink, an operating environment (temperature, humidity, and the like), and the like.

For example, when the medium M is paper, the ink discharged from the recording head 11 is water-based ink and the medium M expands due to the ink discharged from the recording head 11, it is preferable to cause the front tension 45 to be greater than the back tension 35 in many cases. Specifically, a state illustrated in FIG. 3 is preferable in many cases.

For example, when the medium M is a film that stretches easily, it is preferable to cause the front tension 45 to be smaller than the back tension 35 in many cases.

Specifically, a state opposite to the state illustrated in FIG. 3 is preferable in many cases.

The preferable front tension 45 and the preferable back tension 35 change depending on the type of the medium M, the type of the ink, the operating environment (the temperature, the humidity, and the like), and the like. Thus, in the exemplary embodiment, an evaluation is performed on the basis of a test pattern printed on the medium M by the printing apparatus 100 to correct the tension function used for optimizing the tension acting on the medium M, thereby setting optimum values for the front tension 45 and the back tension 35.

Then, even with the front tension 45 made greater than the back tension 35 or with the front tension 45 made smaller than the back tension 35, when the winding unit 40 changes (adjusts) the front tension 45, as long as the feeding unit 30 adjusts the back tension 35 depending on the changes in the front tension 45 such that the difference ΔD between the front tension 45 and the back tension 35 is constant, the movement amount of the medium M fed out from the transport roller pair 21 in the transport direction F can be kept constant.

This application claims priority under 35 U.S.C. § 119 to Japanese Patent Application No. 2016-111600, filed Jun. 3, 2016. The entire disclosure of Japanese Patent Application No. 2016-111600 is hereby incorporated herein by reference.

What is claimed is:

1. A printing apparatus, comprising:

a printing unit configured to perform printing on a medium fed out from a transport roller pair, the transport roller pair being associated with a transport motor;

a feeding unit configured to feed the medium to the transport roller pair, the feeding unit being associated with a feeding motor; and a winding unit configured to wind, into a roll shape, the medium subjected to the printing by the printing unit, the winding unit being associated with a winding motor, the winding unit winding the medium while adjusting a front tension acting on the medium between the transport roller pair and the winding unit, depending on a diameter of the medium wound into the roll shape, and the feeding unit feeding the medium while adjusting a back tension acting on the medium between the transport roller pair and the feeding unit, depending on changes in the front tension, and as a result of controlling one or more of the transport motor, the feeding motor, or the winding motor, the winding unit adjusts the front tension to make the front tension greater as winding of the medium ends.

2. The printing apparatus according to claim 1, wherein a difference between the front tension and the back tension is substantially constant.

3. The printing apparatus according to claim 2, wherein the winding unit adjusts the front tension to make the front tension smaller as the diameter of the medium wound into the roll shape becomes greater.

4. The printing apparatus according to claim 1, wherein the winding unit adjusts the front tension to make the front tension smaller as the diameter of the medium wound into the roll shape becomes greater.

* * * * *